US006764357B2

(12) United States Patent
Wu et al.

(10) Patent No.: US 6,764,357 B2
(45) Date of Patent: Jul. 20, 2004

(54) ELECTRICAL CONNECTOR AND METHOD OF ASSEMBLING THE SAME

(75) Inventors: Jerry Wu, Irvine, CA (US); Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/243,427

(22) Filed: Sep. 12, 2002

(65) Prior Publication Data

US 2004/0053540 A1 Mar. 18, 2004

(51) Int. Cl.[7] ..... H01R 9/24; H01R 13/02
(52) U.S. Cl. ..... 439/885; 439/884; 439/637
(58) Field of Search ..... 439/884, 885, 439/637, 736

(56) References Cited

U.S. PATENT DOCUMENTS 3,663,931 A * 5/1972 Brown ..... 439/75
3,864,014 A * 2/1975 Lynch ..... 439/389
3,963,293 A * 6/1976 McKee ..... 439/62
4,089,581 A * 5/1978 Schwindt ..... 439/637
4,166,667 A * 9/1979 Griffin ..... 439/637
4,978,307 A * 12/1990 Billman et al. ..... 439/83
5,175,928 A * 1/1993 Grabbe ..... 29/884
5,609,502 A * 3/1997 Thumma ..... 439/747
5,810,623 A * 9/1998 Regnier et al. ..... 439/637
5,848,920 A * 12/1998 Klein et al. ..... 439/885
6,102,748 A 8/2000 Lee et al. ..... 439/736
6,196,886 B1 * 3/2001 Sato ..... 439/885

* cited by examiner

*Primary Examiner*—Michael C. Zarroli
(74) *Attorney, Agent, or Firm*—Wei Te Chung

(57) ABSTRACT

A method of assembling an electrical connector (1) comprises the steps of: preparing a dielectric housing (2) defining a plurality of insertion slots therein; preparing a conductive contact strip (3*a*) comprising a plurality of contacts (3) and a carrier (3*b*) connecting with the contacts; preloading the contact strip into the housing; inserting a spacer (5) into the dielectric housing to position the contact strip, the spacer being inserted between an inner side surfaces (210) of the housing and mating portions (31) of the contacts; pulling the contact strip downwardly via a tool (4) gripping slots (35) defined in opposite sides of end portions (36) of the contacts; removing the spacer from the dielectric housing; severing the carrier and end portions of the contact strip; and bending mounting portions (34) of the contacts in an alternating manner.

2 Claims, 12 Drawing Sheets

ELECTRICAL CONNECTOR AND METHOD OF ASSEMBLING THE SAME

BACKGROUND OF THE INVENTION

1. Field of the Invention

The present invention relates to an electrical connector and a method of assembling the same. A copending U.S. patent application Ser. No. 10/269,137 filed on Oct. 10, 2002, entitled "BOARD-TO-BOARD ELECTRICAL CONNECTOR AND METHOD FOR MANUFACTURING THE SAME", and invented by Wei Hua Pan differently while with the same assignee as the instant application, discloses a related design.

2. Description of Related Art

Connectors generally have a large number of conductive contacts aligned in a dielectric housing thereof. Such connector must be designed to fulfill requirements of proper alignment, engagement and coplanarity of the contacts assembled in the housing. One way to assemble contacts of conventional connectors is to assemble the contacts from the top of the housing and pressed thereinto. However, achieving reliability of all the contacts assembled in the housing is difficult for connectors because the pressing force acting on the contacts is large and the contacts often change shape. Another way to retain the contacts in the housing is insert molding as disclosed in U.S. Pat. No. 6,102,748. The connector disclosed in U.S. Pat. No. 6,102,748 comprises a housing comprising a first housing member and a second housing member, two sets of contacts insert molded in opposite sides of the housing, and a shield covering the housing. The method of manufacturing the connector comprises the steps of: 1) insert molding a pair of contact carriers to opposite sides of the first housing member; 2) insert molding the first housing member having the two contact carriers to the second housing member; 3) severing carrier plates from the two contact carriers; and 4) assembling the shield to the housing. Such a method is reliable to retain the contacts in position. However, the manufacture cost is relatively high and the manufacture process is relatively complex.

Hence, an improved electrical connector is desired to overcome the disadvantages of the prior art.

SUMMARY OF THE INVENTION

Accordingly, an object of the present invention is to provide a contact strip for an electrical connector which can be easily and reliably assembled in a housing of the electrical connector.

Another object of the present invention is providing a method of assembling an electrical connector at a low cost and with high efficiency.

To achieve the above objects, a method of assembling an electrical connector in accordance with the present invention comprises the steps of: 1) preparing a dielectric housing defining a plurality of insertion slots therein; 2) preparing a conductive contact strip comprising a plurality of contacts and a carrier connecting with the contacts, each contact comprising a mating portion adapted for electrically contacting a mating contact of a complementary connector, a head portion extending upwardly from the mating portion for being received in a corresponding insertion slot, a retention portion having a plurality of barbs for being secured in the housing, a mounting portion extending downwardly from the retention portion adapted for soldering to a printed circuit board, and an end portion extending downwardly from the mounting portion and defining a pair of slots in opposite respective sides thereof; 3) preloading the contact strip into the dielectric housing until the barbs of the retention portions of the contacts engage inner inclined surfaces of the insertion slots, the mounting portions of the contacts extending beyond the bottom of the housing; 4) inserting a spacer into the dielectric housing to position the contact strip, the spacer being inserted between and engaging with an inner side surface of the housing and the mating portions of the contact strip, the head portions of the contacts being rotatable beyond the top of the insertion slots; 5) pulling the contact strip downwardly via a tool, the pair of slots defined in opposite sides of the mounting portion of each contact being gripped by the tool to downwardly pull the contact strip; 6) removing the spacer from the dielectric housing; 7) severing the carrier and the end portions of the contacts; and 8) bending the mounting portions of the contacts in an alternating manner so that the mounting portions align in two rows.

Other objects, advantages and novel features of the invention will become more apparent from the following detailed description when taken in conjunction with the accompanying drawings.

DETAILED DESCRIPTION OF THE INVENTION

Figure 1:
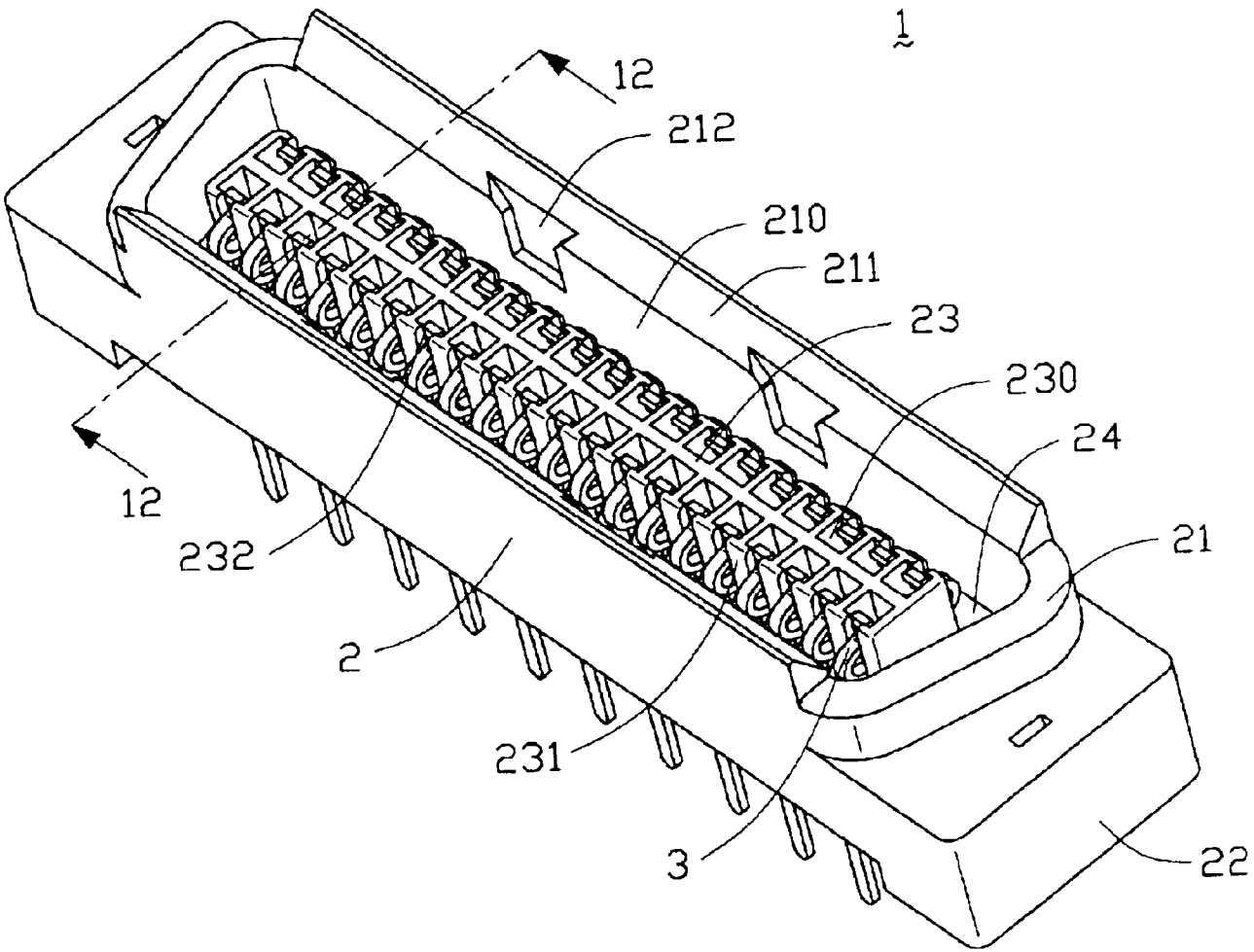
FIG. 1 is a perspective view of an electrical connector in accordance with the present invention.
Figure 2:
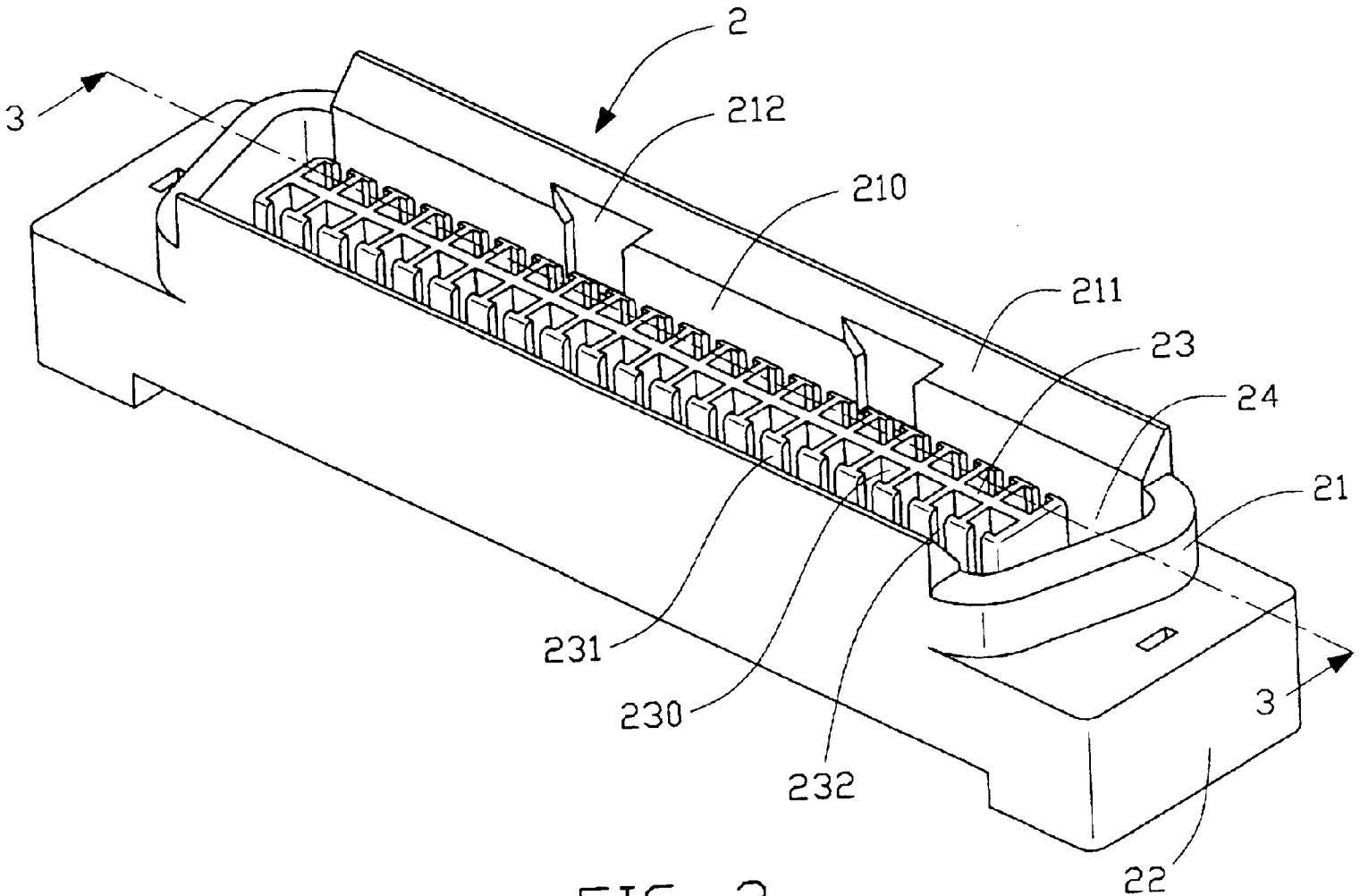
FIG. 2 is a perspective view of a dielectric housing of the electrical connector of FIG. 1.
Figure 3:
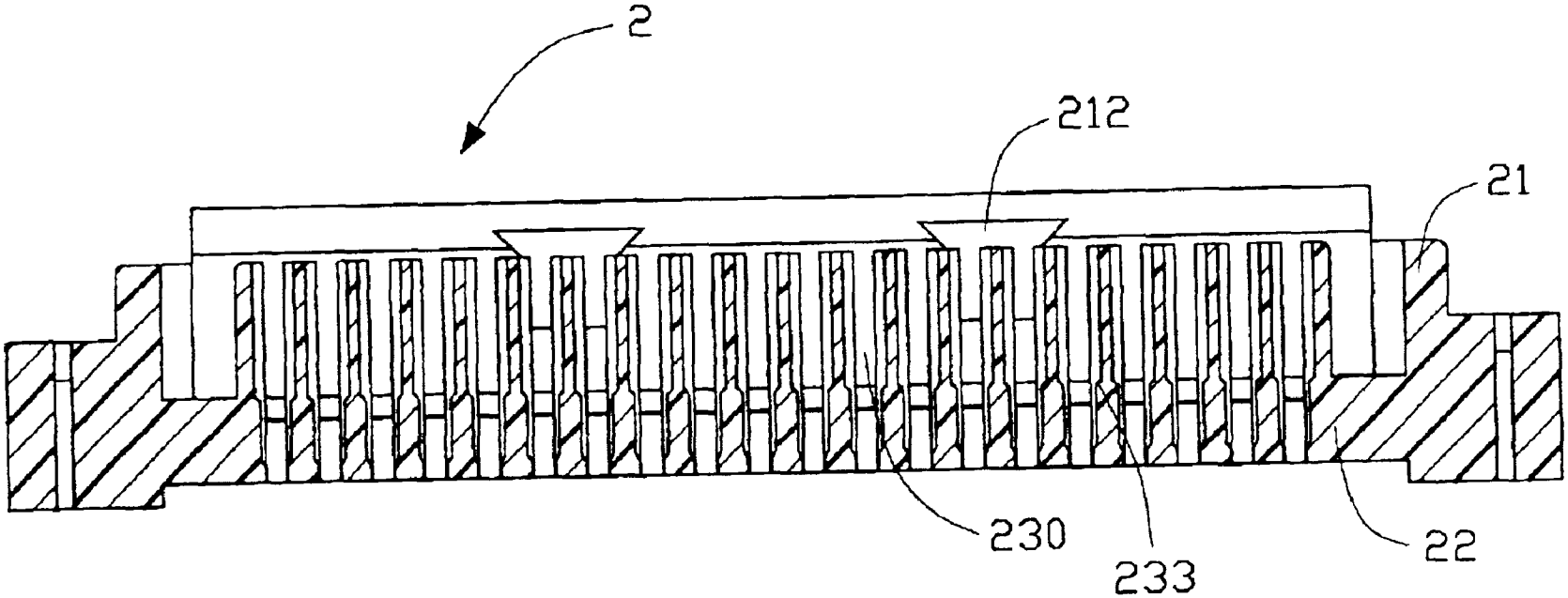
FIG. 3 is a cross sectional view of the dielectric housing taken along line 3—3 of FIG. 2.
Figure 4:
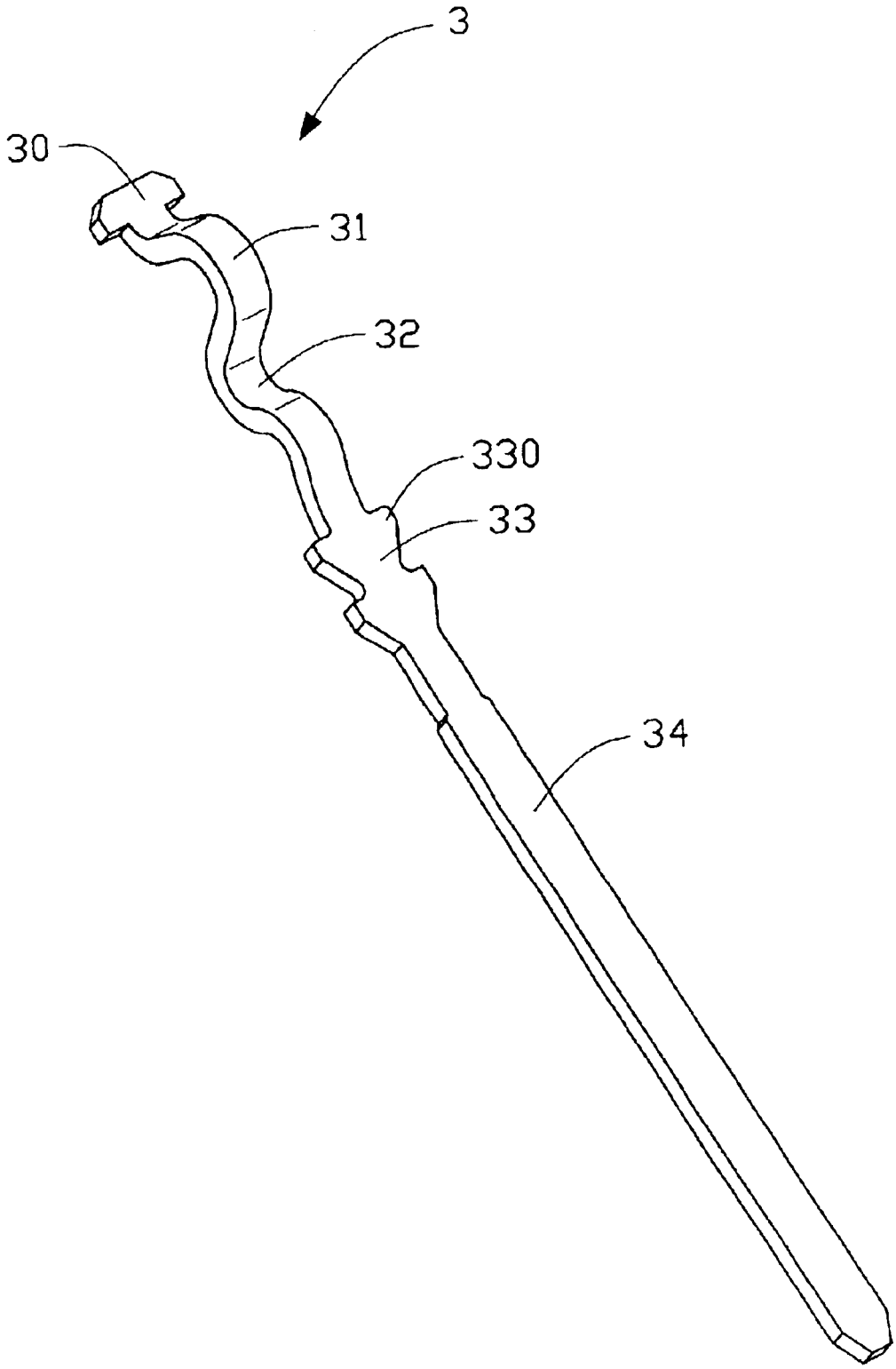
FIG. 4 is a perspective view of a conductive contact for the electrical connector of FIG. 1.

Referring to FIGS. 1–4, an electrical connector 1 in accordance with the present invention comprises a dielectric housing 2, and a plurality of conductive contacts 3 received in the housing 2.

The dielectric housing 2 is a one-piece structure unitarily molded of dielectric material such as plastic or the like. The housing 2 is elongated and comprises a rectangular base 22 and an upstanding mating frame 21. The mating frame 21 is of a known D-shaped configuration and defines a D-shaped cavity 24 for receiving a similarly shaped mating plug of a complementary connector (not shown). The mating frame 21 has a pair of laterally-spaced opposite inner side surfaces 210 and each inner side surface 210 defines a pair of swallow-tailed grooves 212 for engaging with corresponding portions of the complementary connector. A slant surface 211 is formed at an upper end of each inner side surface 210 for properly guiding the insertion of the complementary connector. A rectangular tongue 23 projects into the cavity 24 and defines two rows of insertion slots 230 on opposite respective sides thereof for receiving the contacts 3 therein. The insertion slots 230 are in communication with the cavity 24 defined in the mating frame 21 through a plurality of cutouts 232 and thus a plurality of ridges 231 is formed on opposite sides of the tongue 23.

Figure 5:
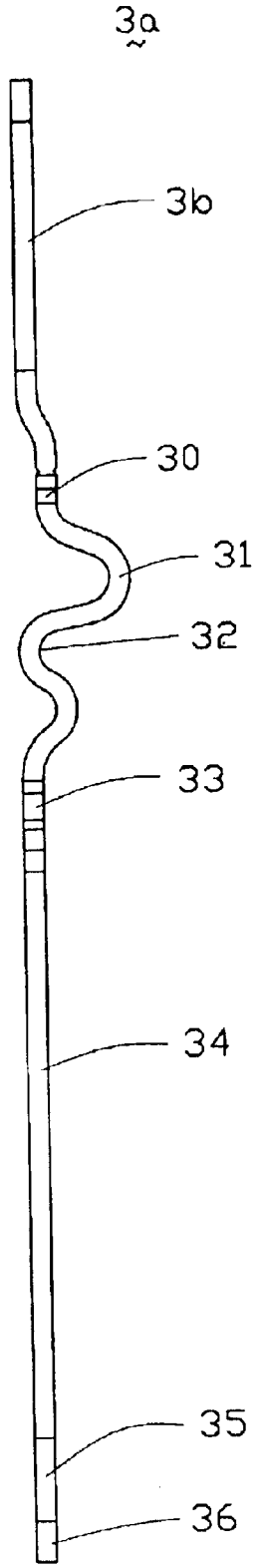
FIG. 5 is a side elevational view of a contact strip having a plurality of contacts for the electrical connector of FIG. 1.
Figure 6:
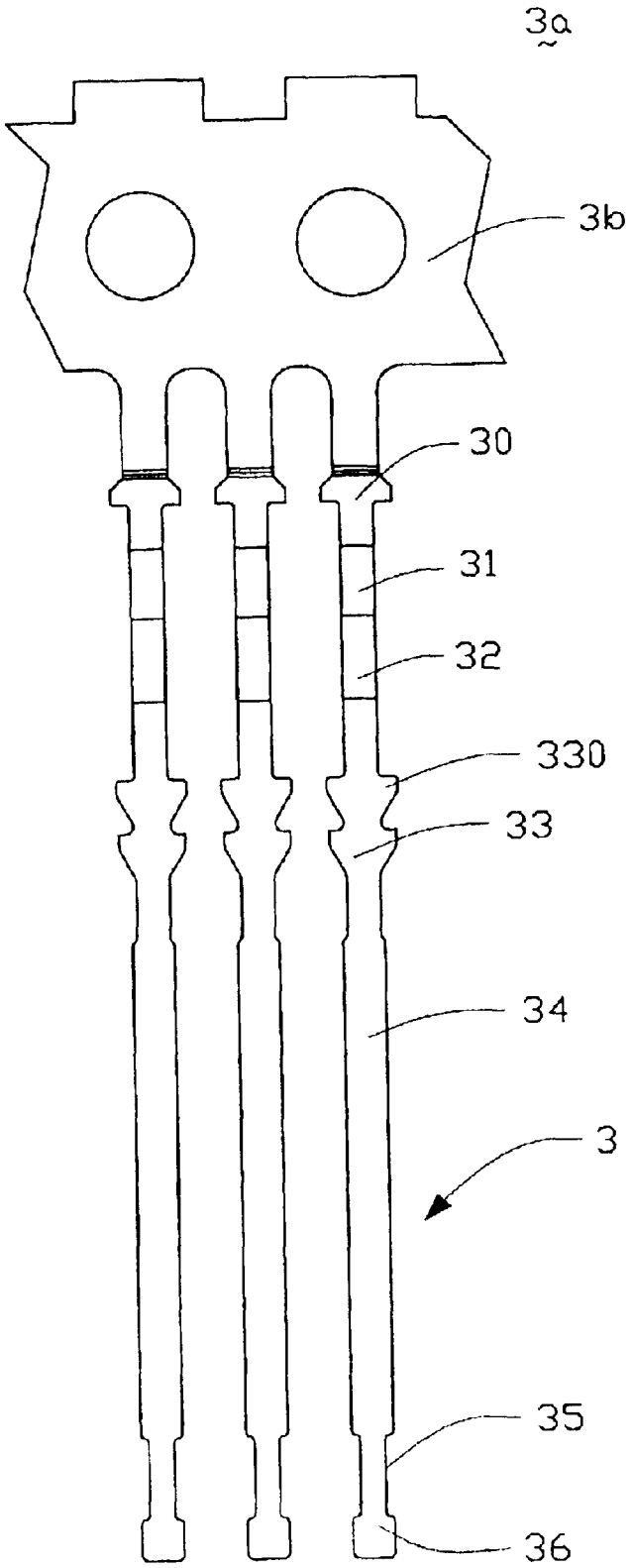
FIG. 6 is a front elevational view of the contact strip having a plurality of contacts for the electrical connector of FIG. 1.

Referring to FIGS. 5 and 6, a contact strip 3*a* is stamped from a resilient metal sheet and includes a carrier 3*b* and a plurality of contacts 3. Each contact 3 includes a retention portion 33 with a plurality of barbs 330 formed on opposite sides thereof for engaging with a corresponding insertion slot 230 of the tongue 23. The contact 3 further includes a curved mating portion 31 for electrically contacting with a corresponding mating contact of the complementary connector, and a curved transition portion 32 connecting the mating portion 31 with the retention portion 33. A T-shaped head portion 30 extends upwardly from an upper end of the mating portion 31 for engaging with two corresponding ridges 231 formed on the tongue 23 of the housing 2. A mounting portion 34 extends downwardly from the retention portion 33 for solder connection to a printed circuit board (not shown). An end portion 36 extends downwardly from the mounting portion 34. A pair of slots 35 is defined in opposite sides of the end portion 36 for being conveniently gripped by a tool 4 (shown in FIG. 10). The carrier 3*b* integrally connects with upper ends of the T-shaped head portions 30.

Figure 7:
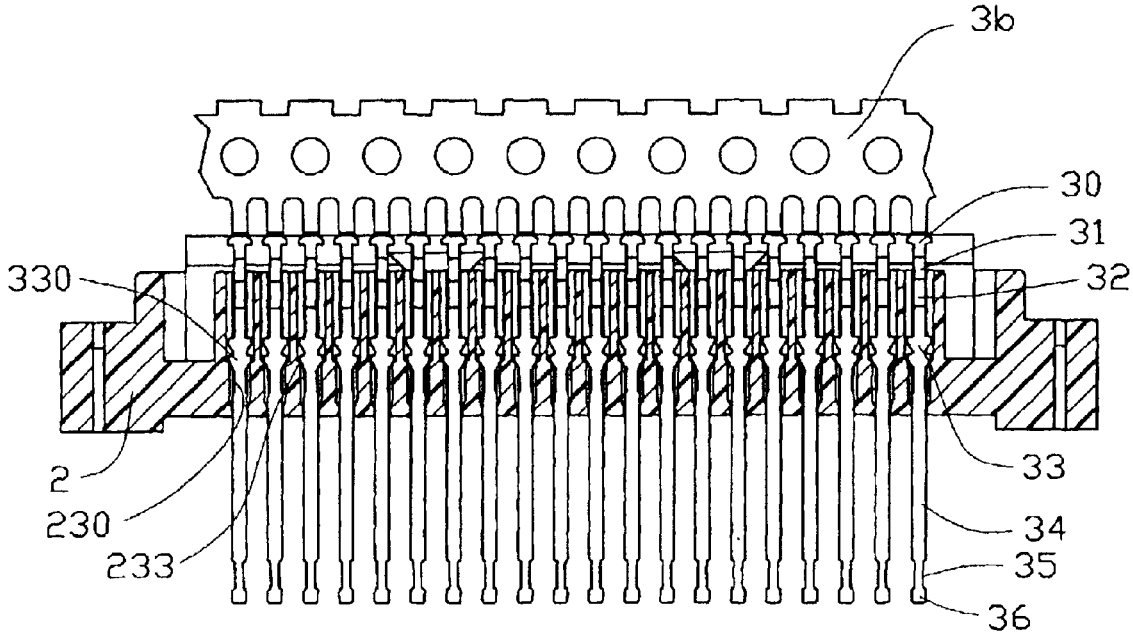
FIG. 7 is a cross sectional view illustrating the contact strip preloaded in the dielectric housing.
Figure 8:
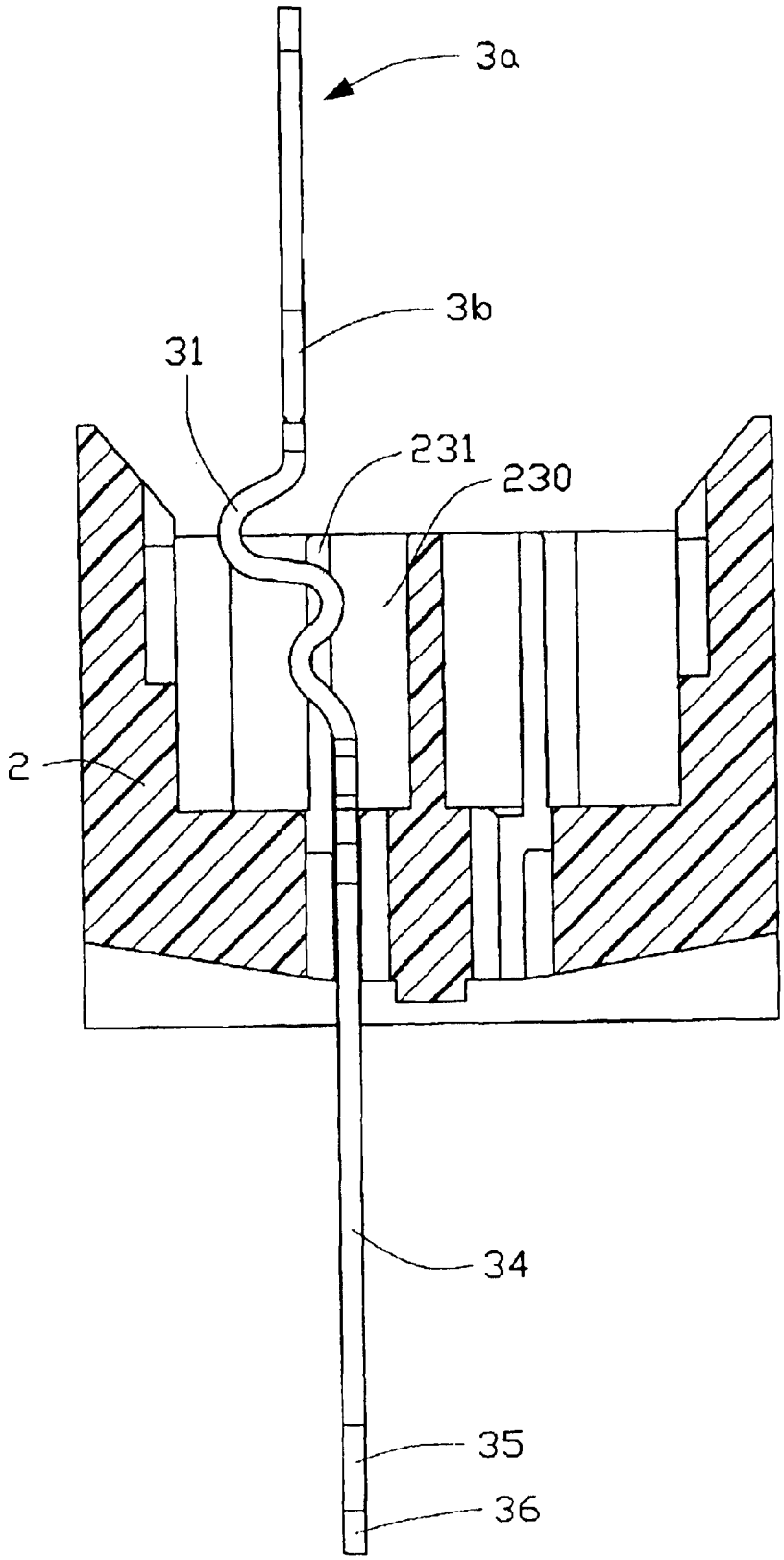
FIG. 8 is another cross sectional view illustrating the contact strip preloaded in the dielectric housing.

In assembly, a pair of contact strips 3*a* will be respectively inserted into the two rows of insertion slots 230 of the dielectric housing 2 using the same method. Therefore, only the assembly process of one contact strip 3*a* to the dielectric housing 2 will be described in detail herein. The method comprises the steps of:

1) Preloading the contact strip 3*a* into the housing 2;

Referring to FIGS. 7 and 8, the contact strip 3*a* is top loaded into one row of slots 230 until the barbs 330 of the retention portions 33 of the contact strip 3*a* engage inner inclined surfaces 233 of the slots 230. The mounting portions 34 extend beyond the bottom of the housing 2.

Figure 9:
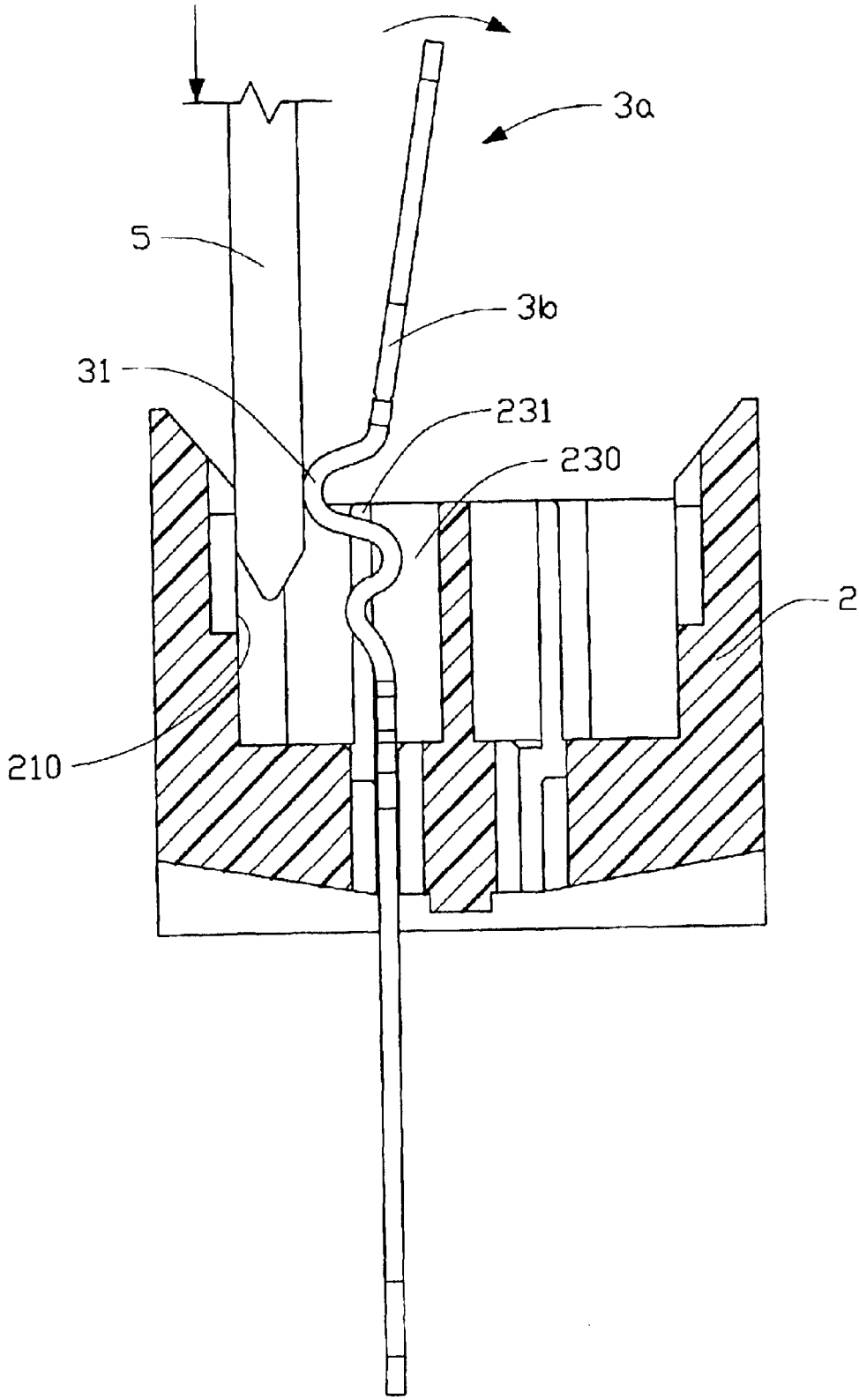
FIG. 9 is a cross sectional view illustrating a spacer inserted between an inner side surface of the housing and the contact strip.

2) Inserting a spacer 5 into the dielectric housing to position the contact strip;

Referring to FIG. 9, a spacer 5 is inserted between and engages with an inner side surface 210 of the mating frame 21 and the mating portions 31 of the contact strip 3*a*. Therefore, the T-shaped head portions 30 are rotatable beyond the top of the insertion slots 230 defined in the tongue 23.

Figure 10:
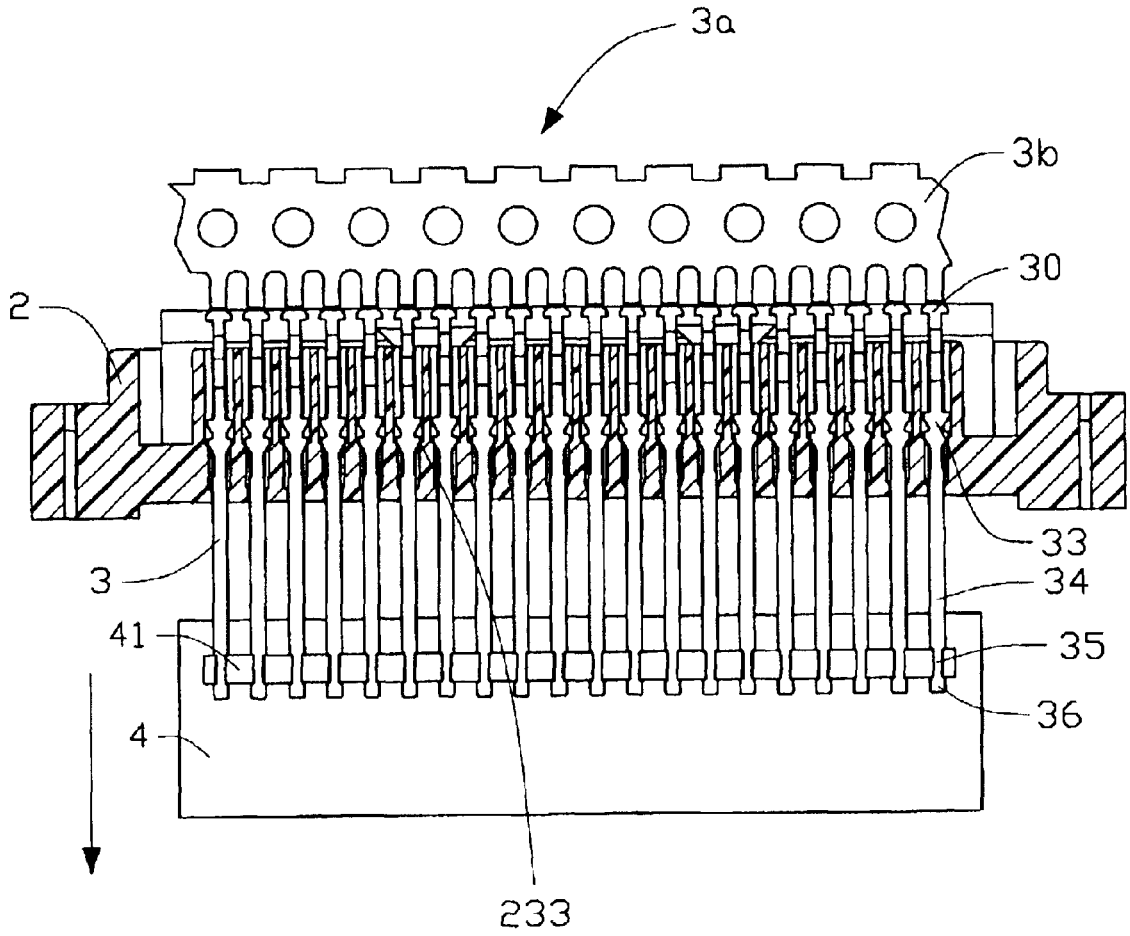
FIG. 10 is a cross sectional view illustrating how the contacts being pulled by a tool.

3) Pulling the contact strip 3*a* downwardly;

Referring to FIG. 10, the contact strip 3*a* is pulled downwardly by the tool 4. The tool 4 is a substantially rectangular board, end a plurality of protrusi ns 41 is formed on side surface adjacent to an upper end thereof. The pair of slots 35 defined in the opposite sides of the end portion 36 of each contact 3 is gripped by corresponding two protrusions 41 of the tool 4 to downwardly pull the contact strip 3*a*. Thus, when a vertical force is applied to the tool 4, the contact strip 3*a* will be pulled downwardly to a predetermined position where the T-shaped head portion 30 of each contact is in a position shown in FIG. 1.

Figure 11:
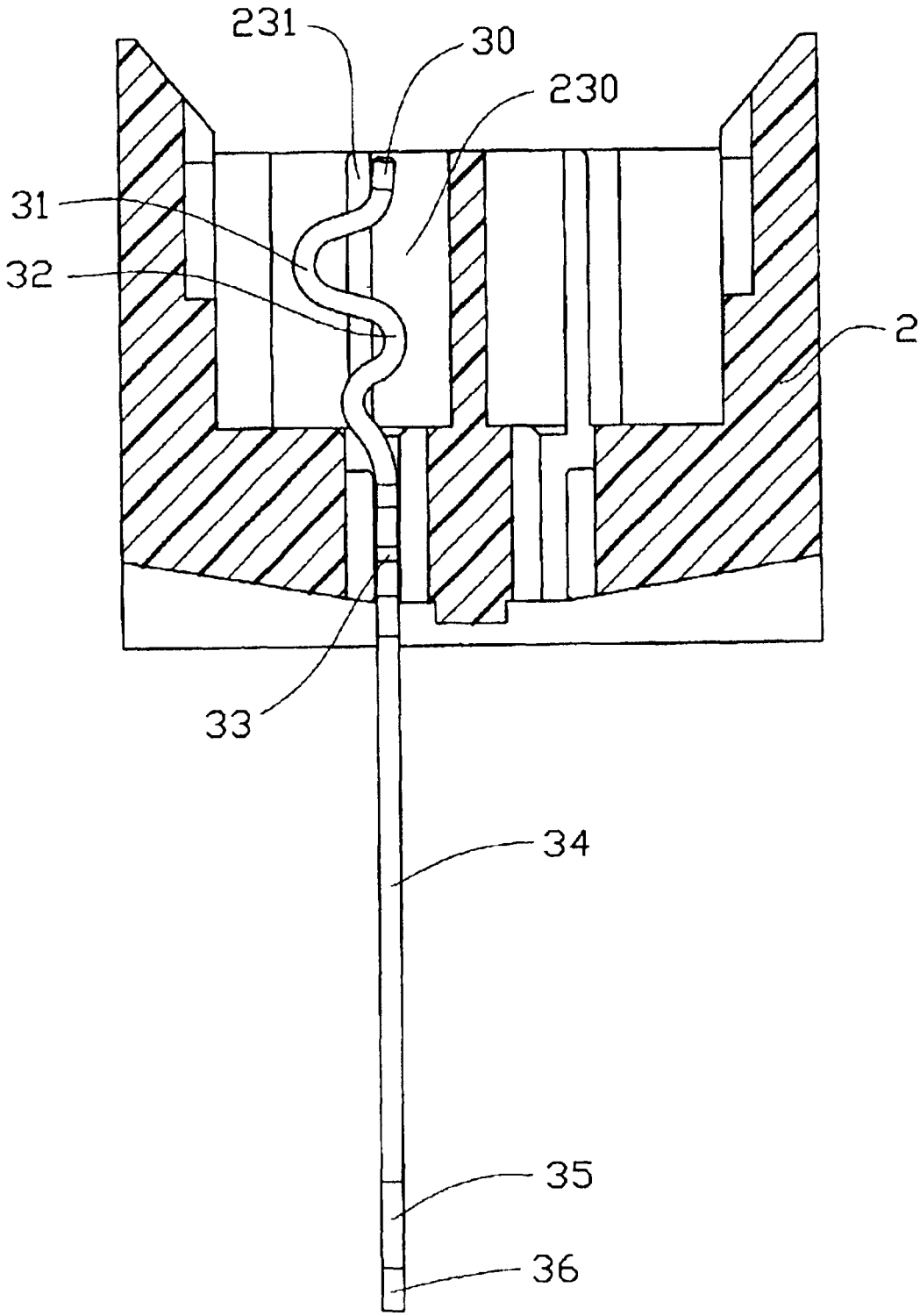
FIG. 11 is a cross sectional view illustrating the contacts being fully inserted into the housing, with a carrier of the contact strip being removed.

4) Removing the spacer 4 from the dielectric housing 2;

Now referring to FIG. 11 in conjunction with FIG. 9, the spacer 4 is removed from the dielectric housing 2.

5) Severing the carrier 3*b* and optionally the end portions 36 of the contact strip 3*a;*

Figure 12:
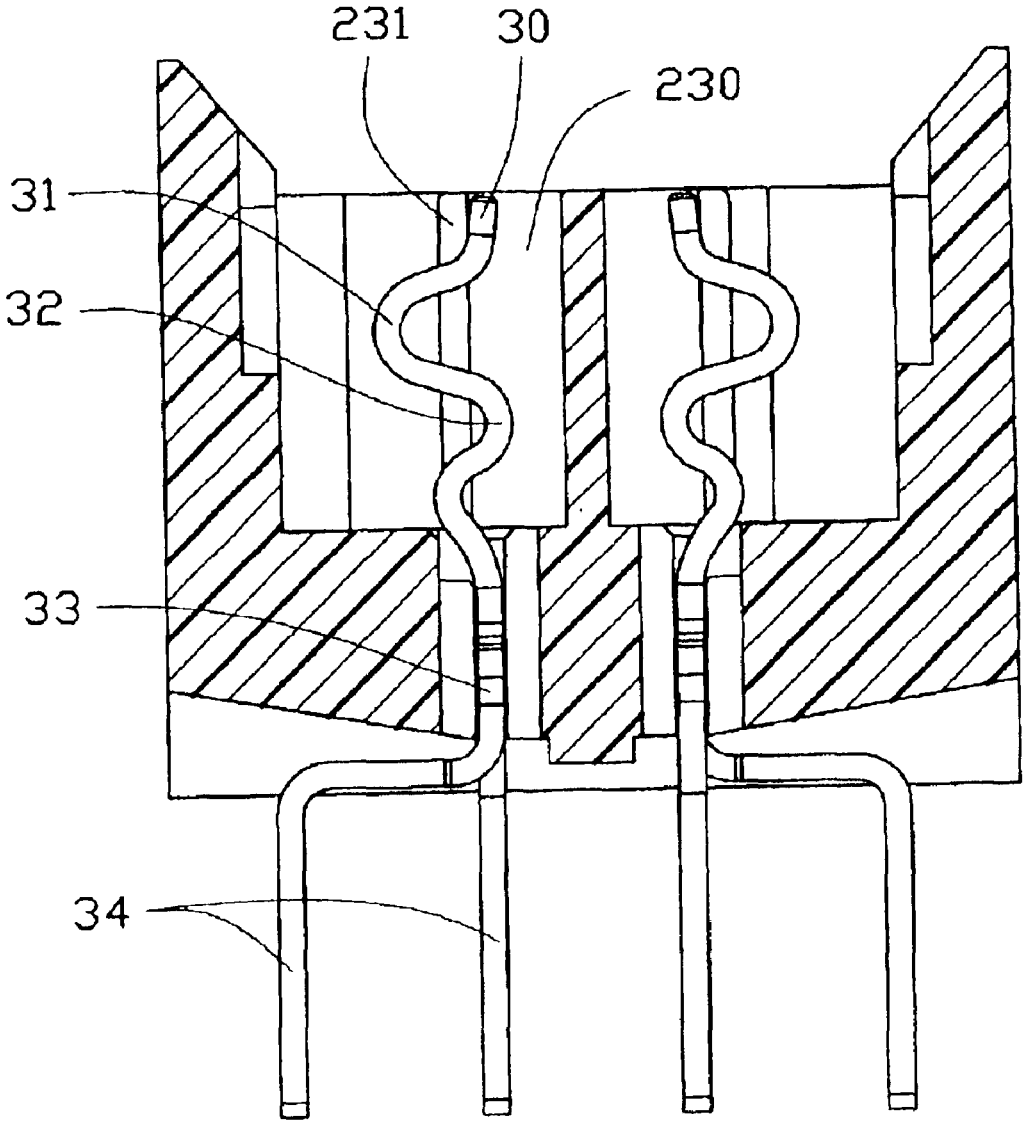
FIG. 12 is a cross sectional view of the electrical connector taken along line 12—12 of FIG. 1.

Referring to FIGS. 11 and 12 In conjunction with FIG. 10, the carrier 3*b* and the end portions 36 of the contacts 3 are severed from the contact strip 3*a*. Thus, the contacts 3 are individually separated.

6) Bending the mounting portions 34 of the contacts 3.

Referring to FIG. 12, the mounting portions 34 of the contacts 3 are bent in an alternating manner so that the mounting portions 34 align in two rows.

Repeating the steps described above, the other contact strip 3*a* is assembled into the other row of insertion slots 23 of the electrical connector 1 easily and reliably. In the whole assembling process, a top-loading force applied to the contacts 3 is relatively small. The forces acting on the contact strip 3*a*, including the force pulling the contacts 3 downwardly, are minimized. Therefore, the shape of the contact 3 changes minimally. In addition, the tool 4 efficiently and conveniently helps assembling the contacts 3 into the electrical connector 1 and the manufacture cost of the electrical connector 1 is reduced compared with that of an electrical connector produced by insert molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact strip stamped from sheet metal for use with an insulative housing of an electrical connector coupling to a complementary connector and mounted on a printed circuit board, comprising:

a carrier;

a plurality of juxtaposed contacts connected to the carrier, respectively, each of the contacts including a retention portion adapted to be secured to the housing, a tail portion located below the retention portion and adapted to be mounted to the printed circuit board, a mating portion located above the retention portion and adapted to be engaged with another terminals of said complementary connector, a head portion located above the mating portion and adapted to be engaged with the housing for preloading;

the carrier connected to the head portions of the contacts, wherein said tail portion includes a gripping section configured to be adapted to be engaged with a tool for pulling the contact in an assembling direction during assembling the contact into the housing; wherein said gripping section is configured to be adapted to be optionally removed from the contact after assembled, without jeopardizing mounting function of the tail portion.

2. A contact strip stamped from sheet metal for use with an insulative housing of an electrical connector coupling to a complementary connector and mounted on a printed circuit board, comprising:

a carrier:

a plurality of juxtaposed contacts connected to the carrier, respectively, each of the contacts including a retention portion adapted to be secured to the housing, a tail portion located below the retention portion and adapted to be mounted to the printed circuit board, a mating portion located above the retention portion and adapted to be engaged with another terminals of said complementary connector, a head portion located above the mating portion and adapted to be engaged with the housing for preloading;

the carrier connected to the head portions of the contacts, wherein said tail portion includes a gripping section configured to be adapted to be engaged with a tool for pulling the contact in an assembling direction during assembling the contact into the housing; wherein said gripping section is coplanar with the corresponding tail portion.

* * * * *